US011912317B2

(12) United States Patent
Metzger

(10) Patent No.: US 11,912,317 B2
(45) Date of Patent: Feb. 27, 2024

(54) RAIL VEHICLE AND METHOD FOR SURVEYING A TRACK SECTION

(71) Applicant: PLASSER & THEURER EXPORT VON BAHNBAUMASCHINEN GMBH, Vienna (AT)

(72) Inventor: Bernd Metzger, Chesapeake, VA (US)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 869 days.

(21) Appl. No.: 16/966,555

(22) PCT Filed: Jan. 2, 2019

(86) PCT No.: PCT/EP2019/050013
§ 371 (c)(1),
(2) Date: Jul. 31, 2020

(87) PCT Pub. No.: WO2019/149456
PCT Pub. Date: Aug. 8, 2019

(65) Prior Publication Data

US 2020/0361502 A1 Nov. 19, 2020

(30) Foreign Application Priority Data

Feb. 2, 2018 (AT) ..... A 29/2018

(51) Int. Cl.
*B61K 9/08* (2006.01)
*E01B 35/06* (2006.01)

(52) U.S. Cl.
CPC ..... *B61K 9/08* (2013.01); *E01B 35/06* (2013.01)

(58) Field of Classification Search
CPC ..... B61K 9/08; E01B 35/06; B61L 23/047
See application file for complete search history.

(56) References Cited

U.S. PATENT DOCUMENTS 4,179,216 A 12/1979 Theurer et al.
4,654,973 A * 4/1987 Worthy ..... E01B 35/04 33/287

(Continued)

FOREIGN PATENT DOCUMENTS

CN 101765689 A 6/2010
CN 102756744 A 10/2012

(Continued)

OTHER PUBLICATIONS

Oberlechner et al.: "POS/TG—Innovation auf dem Gebiet der Gleisgeometriemessungen" [Innovation in track geometry measurement], El—Eisenbahningenieur (52), Sep. 2001 pp. 6-9—English Summary on p. 9.

*Primary Examiner* — Yaritza Guadalupe-Mccall
(74) *Attorney, Agent, or Firm* — Laurence A. Greenberg; Werner H. Stemer; Ralph E. Locher

(57) ABSTRACT

A rail vehicle has a vehicle frame which, supported on on-track undercarriages, is mobile on the rails of a track. The rail vehicle includes a first measuring platform with a first inertial measuring system for recording a track course. A second measuring platform is arranged on the rail vehicle, with a second inertial measuring system and at least one sensor device for recording surface points of a track section. The second measuring platform and the second inertial measuring system enable the movement of the sensor device in the three-dimensional space to be recorded in a simple manner.

13 Claims, 2 Drawing Sheets

(56) References Cited

U.S. PATENT DOCUMENTS

| | | | | |
|---|---|---|---|---|
| 5,113,767 | A * | 5/1992 | Theurer | E01B 27/20 104/8 |
| 5,199,176 | A * | 4/1993 | Theurer | B61K 9/08 33/651.1 |
| 5,893,043 | A | 4/1999 | Moehlenbrink et al. | |
| 6,415,522 | B1 * | 7/2002 | Ganz | B61K 9/08 33/1 Q |
| 7,979,995 | B2 | 7/2011 | Theurer et al. | |
| 9,810,533 | B2 | 11/2017 | Fosburgh | |
| 10,459,001 | B2 * | 10/2019 | Foerster | B60T 8/172 |
| 10,589,763 | B2 * | 3/2020 | Buerger | G01C 11/06 |
| 11,014,587 | B2 * | 5/2021 | Corbin | G01P 15/18 |
| 11,169,269 | B2 * | 11/2021 | Mesher | B61L 15/0054 |
| 11,377,130 | B2 * | 7/2022 | Mesher | B61L 27/04 |
| 2004/0122569 | A1 | 6/2004 | Bidaud | |
| 2009/0070064 | A1 | 3/2009 | Farritor et al. | |
| 2010/0004804 | A1 | 1/2010 | Anderson et al. | |
| 2017/0066459 | A1 | 3/2017 | Singh | |
| 2019/0136462 | A1 | 5/2019 | Buerger et al. | |
| 2020/0361502 | A1 * | 11/2020 | Metzger | E01B 35/06 |

FOREIGN PATENT DOCUMENTS

| | | | |
|---|---|---|---|
| CN | 203020332 | U | 6/2013 |
| CN | 107097807 | A | 8/2017 |
| DE | 19532104 | C1 | 1/1997 |
| DE | 102008062143 | B3 | 5/2010 |
| DE | 102013210361 | A1 | 12/2014 |
| EP | 1361136 | A1 | 11/2003 |
| GB | 2403861 | A | 1/2005 |
| JP | S53149058 | A | 12/1978 |
| JP | 2012208043 | A | 10/2012 |
| KR | 20100068595 | A | 6/2010 |
| WO | 2017215777 | A2 | 12/2017 |

* cited by examiner

RAIL VEHICLE AND METHOD FOR SURVEYING A TRACK SECTION

FIELD OF TECHNOLOGY

The invention relates to a rail vehicle having a vehicle frame which is supported on on-track undercarriages and mobile on rails of a track, comprising a first measuring platform with a first inertial measuring system for recording a track course. The invention further relates to a method for surveying a track section by means of the rail vehicle.

PRIOR ART

For reliable maintenance of a track permanent way, regular checks are required. In the process, track measuring vehicles are used which are designed for recording a present track geometry of a track section. Maintenance measures are planned and carried out on the basis of collected measuring data. Serving as measuring devices are a variety of sensors which record the track itself as well as the track surroundings. The latter takes place, for example, by means of camera systems arranged on the track measuring vehicle.

In order to determine the track course or the relative track position, modern track measuring vehicles use a so-called inertial measuring system (Inertial Measurement Unit, IMU). Such an inertial measuring system is described in the trade journal Eisenbahningenieur (52) September 2001 on pages 6-9. DE 10 2008 062 143 B3 also describes an inertial measuring principle for recording a track position.

SUMMARY OF THE INVENTION

It is the object of the invention to show improvements over the prior art for a rail vehicle and a method of the type mentioned at the beginning.

According to the invention, these objects are achieved by way of the claimed invention. Advantageous further developments of the invention become apparent from the dependent claims.

In this, a second measuring platform is arranged on the rail vehicle, comprising a second inertial measuring system and at least one sensor device for recording surface points of a track section. By means of the second measuring platform and the second inertial measuring system, the movement of the sensor device in the three-dimensional space is recorded in a simple manner. In this way, the measurement data recorded by the sensor device can be exactly assigned spatially.

Advantageously, a computer is arranged directly on the rail vehicle, to which measurement data of the inertial measuring systems and the sensor device are supplied and which is designed for the transformation of coordinates of the surface points from a coordinate system, moved along with the sensor device, of the second measuring platform into a coordinate system, following the track course, of the first measuring platform. In the result, the surface points recorded by the sensor device are referenced to the track course. Thus it is possible to straightaway make a statement about the position of recorded objects with respect to the track course.

In a further improvement, an evaluation device is arranged on the rail vehicle, the evaluation device being designed for comparison of the coordinates of the surface points in the coordinate system of the first measuring platform to a prescribed clearance profile of the track section.

An advantageous embodiment of the invention provides that the first measuring platform is arranged on one of the on-track undercarriages. This permits a simple recording of the track course by means of the first inertial measuring system.

In this, it is favourable if the first measuring platform has a measuring frame, arranged on wheel axles of the on-track undercarriage, on which the first inertial measuring system is arranged. Thus, the motions of the first inertial measuring system in the three-dimensional space remain uninfluenced by springy relative movements of the on-track undercarriage. The longitudinal inclinations of the track are recorded directly.

In order to compensate the influence of transverse motions or pendulum motions of the on-track undercarriage, it is advantageous if at least two position measuring devices for determining the position of the measuring frame relative to the rails of the track are arranged on the measuring frame. With this, the exact position of the measuring frame relative to the rails is continuously recorded and taken into consideration when determining the track course by means of the first inertial measuring system.

In an advantageous embodiment of the invention, the second measuring platform is arranged at a front side of the rail vehicle. In this manner, a wide surrounding area of the rail vehicle can be recorded with only a few sensors.

Additionally, it is favourable if the sensor device comprises a laser scanner for recording the surface points as a point cloud. By means of such a sensor, a precise and high-resolution recording of the surfaces of the track and its surroundings can be realized. In this, redundant or supplementary rotation- and line scanners increase the precision and quality of the measurement data.

The method according to the invention for surveying a track section by means of an above-mentioned rail vehicle provides that the track course—in particular as a course of motion of a coordinate system of the first measuring platform—is recorded by means of the first inertial measuring system, that a course of motion of the sensor device—in particular as a course of motion of a coordinate system of the second measuring platform—is recorded by means of the second inertial measuring system, and that surface points of the track section are recorded by means of the sensor device.

In a further development of the method, coordinates of the surface points are transformed from a coordinate system, moved along with the sensor device, of the second measuring platform into a coordinate system, following the track course, of the first measuring platform. This takes place either online by means of a computer carried along on the rail vehicle or offline in a remote system central.

In an advantageous additional method step, coordinates of the surface points in the coordinate system of the first measuring platform are compared to a clearance profile of the track section. In this way, clearance profile violations are recognized automatically.

In this, it is favourable if a clearance profile transgression of a surface point is displayed in an output device. This takes place either directly in the rail vehicle or in a system central in order to preclude dangerous situations.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
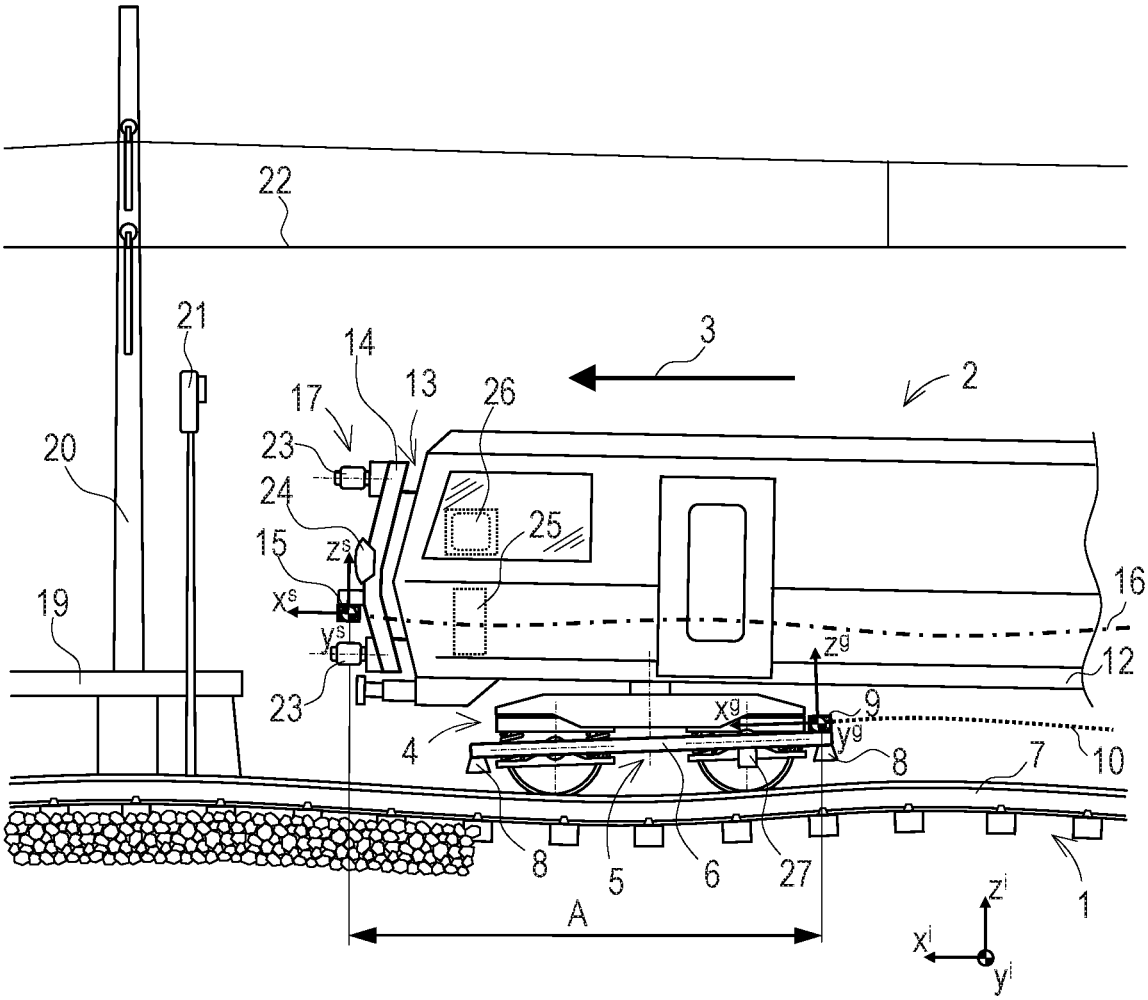
FIG. 1 a rail vehicle on a track.

For clear explanation of the present invention, warping of a track 1 in FIG. 1 is shown in a greatly exaggerated way. A rail vehicle 2 is moving along the track 1 in a measuring direction 3. A first measuring platform 5 is arranged at a front on-track undercarriage 4. Favourably, this first measuring platform 5 comprises a measuring frame 6 which is fastened to axles of the on-track undercarriage 4 designed as a bogie. Additionally, two position measuring devices 8 can be mounted on the first measuring platform 5 for each rail 7 of the track 1 in order to record relative motions of the first measuring platform 5 with respect to the rails 7. The respective position measuring device 8 comprises, for example, a laser directed at the rail 7 and a camera for recording the laser projection.

On the first measuring platform 5, a first inertial measuring system 9 is set up which records a first spatial curve 10 with respect to an inertial reference system xi, yi, zi. This first spatial curve 10 runs parallel to a track axis 11 at a known distance, the track axis extending symmetrically between inner edges of the two rails 8. Thus, a relative track course is determined. A coordinate system xg, yg, zg of the first measuring platform 5 carried along is moved along this first spatial curve 10. Optionally, a spatial curve recording takes place for each rail 7 of the track 1 by means of the position measuring devices 8.

At a front side 13 of the rail vehicle 2, a second measuring platform 14 is arranged, rigidly connected to a vehicle frame 12. Fastened to this second measuring platform 14 is a second inertial measuring system 15 for recording a second spatial curve 16. A coordinate system xs, ys, zs of the second measuring platform 14 carried along is moved along the second spatial curve 16.

In each inertial measuring system 9, 15, three acceleration meters and three rotation rate sensors are orthogonally assembled in each case. By means of a position integration, the relative position with respect to the inertial reference system xi, yi, zi is determined from the measured rotation rates of the respective inertial measuring system 9, 15 which exist in the associated moved-along coordinate system xg, yg, zg or xs, ys, zs.

The second measuring platform 14 serves as carrier of a sensor device 17 which is designed for recording surface points P of a track section 18 to be inspected. In this, various objects are located along the track section 18 next to the track 1, such as, for example, track platforms 19, masts 20, signalling devices 21 and catenaries 22. To begin with, by recording the surface points P, the position of these objects 19-22 with respect to the coordinate system xs, ys, zs of the second measuring platform 14 can be determined.

The sensor device 17 comprises several laser scanners, for example two 2D rotation scanners 23 and two 2D fan scanners 24. Thus, with a known travel speed of the rail vehicle 2, a measurement result in the shape of a three-dimensional point cloud ensues. The resolution thereof can be varied by adjusting the scanning rates of the scanners 23, 24 as well as the travel speed. The coordinates of the individual surface points P of this point cloud are stored in a computer 25 with reference to the coordinate system xs, ys, zs of the second measuring platform 14.

Additionally, the computer 25 is set up for transformation of the coordinates of the surface points P from the coordinate system xs, ys, zs, moved along with the sensor device 17, of the second measuring platform 14 into the coordinate system xg, yg, zg, following the track course, of the first measuring platform 5. In this, a distance A between both inertial measuring systems 9, 15 and the known travel speed are taken into account in order to synchronize the measurement values of the two inertial measuring systems 9, 15.

Figure 2:
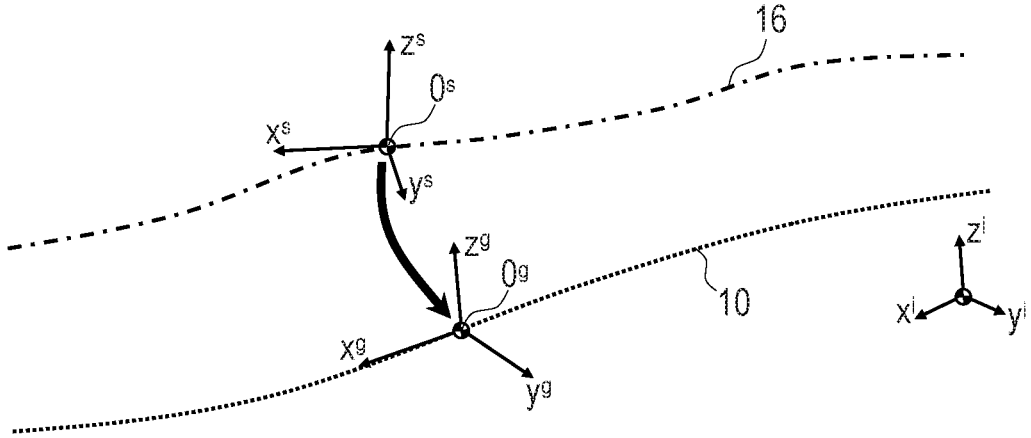
FIG. 2 a coordinate transformation.

The coordinate transformation is illustrated in FIG. 2. The coordinate system xs, ys, zs of the second measuring platform 14 is transferred into the coordinate system xg, yg, zg of the first measuring platform 5, wherein the inertial reference system xi, yi, zi serves as a common basis.

Figure 3:
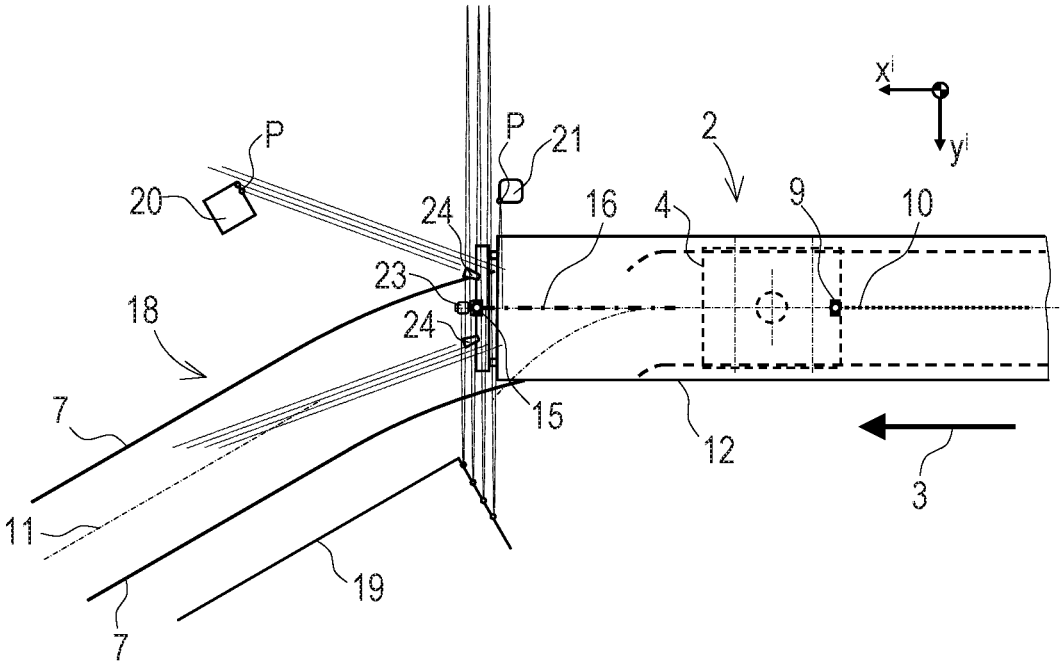
FIG. 3 a recording situation when entering a curve.
Figure 4:
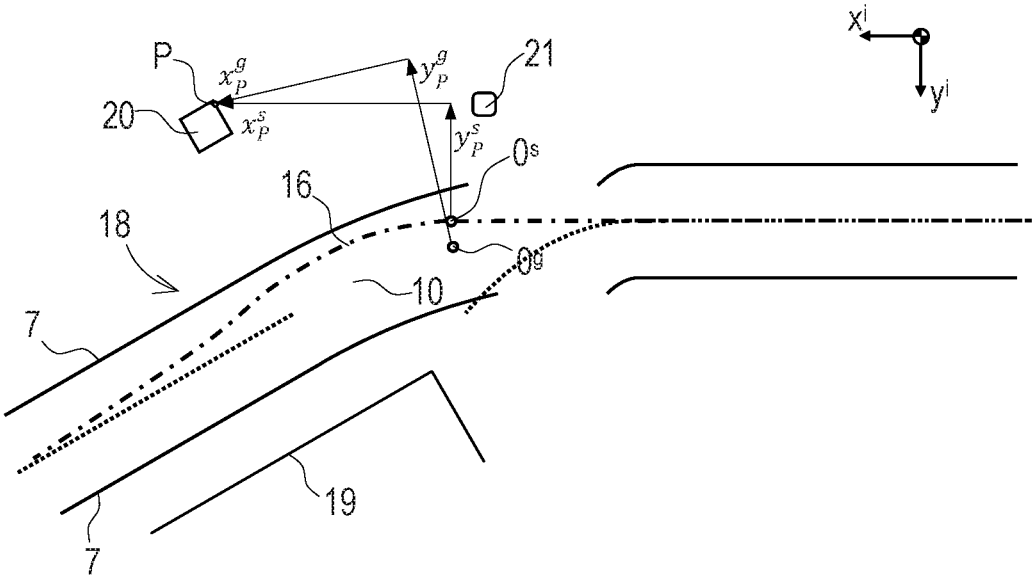
FIG. 4 a recording situation according to FIG. 3 with coordinate transformation.

With reference to FIGS. 3 and 4, the procedure for an exemplary surface point P is explained further. The rail vehicle 2 is shown in FIG. 3 in a top view and is situated in a curve entry of the track section 18. During forward travel, the 2D rotation scanners 23 scan in a helical motion the track 1 and the objects 19-22 located alongside. The surface points P recorded in the process correspond to a profile of the track surroundings. This point cloud is supplemented by surface points P which are recorded by means of the 2D fan scanners 24. In this, the 2D fan scanners 24 are aimed at regions in which the vision of the 2D rotation scanners 23 is obstructed.

During traversing of the curve, the two inertial measuring systems 9, 15 record different spatial curves 10, 16. In particular, the swinging out of the vehicle portion located forward of the front on-track undercarriage 4 causes a significant deviation. In FIG. 4, the two spatial curves 10, 16 are superimposed over one another as seen from above, wherein points of origin 0*g*, 0*s* of the two moved-along coordinate systems xg, yg, zg or xs, ys, zs are synchronized by means of the known distance A and the travel speed.

For each recorded surface point P, the coordinates x_p^s, y_p^s in the coordinate system xs, ys, zs of the second measuring platform 14 can be transformed into coordinates x_p^g, y_p^g in the coordinate system xg, yg, zg of the first measuring platform 5. The transformed coordinates x_p^g, y_p^g of the respective surface point P indicate the position with regard to the track course or the track axis 11.

The results of the coordinate transformation are used especially for clearance gauge control. In this, the profile data of the track surroundings are evaluated by means of an evaluation device with respect to the track axis 11. At the respective control location, those surface points P are taken into account of which the x-coordinate (in the longitudinal direction of the track) in the moved-along coordinate system xg, yg, zg of the first measuring platform 5 equals zero. The y-coordinates and z-coordinates of these surface points P are compared to limit values of a clearance profile to be observed. During this, it is useful to shift the zero point 0*g* of the coordinate system xg, yg, zg of the first measuring platform 5 into the track axis 11, because standardized clearance profiles also refer to the track axis 11.

A clearance profile transgression exists if a surface point P lies within the prescribed clearance profile. The corresponding y-coordinate or z-coordinate is then smaller than a prescribed clearance profile limit value. In order to avoid any danger of collision, clearance profile transgressions are displayed in a control central. Also, an instant display in an output device 26 of the rail vehicle 2 is useful. Advantageously in this, the computer 25 is designed as an evaluation device for an online comparison of the coordinates of the surface points P to the clearance profile limit values.

In particular, during a clearance profile transgression, output data are generated which link position data of an object 19-22 violating the clearance profile to a kilometre marking of the controlled track section 18. In this manner, any trouble spot in a track network can be specifically located in order to take suitable countermeasures. In this, a path measuring device 27 or a GNSS receiver is arranged on the rail vehicle 2. Additionally, a fixed point measuring device arranged on the rail vehicle 2 is useful to determine an absolute position relative to fixed points located beside the track 1.

A further advantage of the invention exists in that the surface points P of the rail inner edges are also recorded by means of the sensor device 17. Thus, by the above-described coordinate transformation, it is possible to determine the track course. This can take place offline, for example after a measuring run, in order to check the precision of the track course recorded by means of the first measuring platform 5. The present invention thus includes redundant systems for determining the track course.

The invention claimed is:

1. A rail vehicle, comprising:

a vehicle frame supported on on-track undercarriages for mobility on rails of a track;

a first measuring platform mounted on the rail vehicle, said first measuring platform having a first inertial measuring system for recording a track course and a first spatial curve;

a second measuring platform mounted on the rail vehicle, said second measuring platform having a second inertial measuring system for recording a second spatial curve and at least one sensor device for recording surface points of a track section of the track; and a movement of said at least one sensor device in three-dimensional space being recorded by said second inertial measuring system.

2. The rail vehicle according to claim 1, further comprising a computer configured to receive measurement data of said first and second inertial measuring systems and of said sensor device and configured for a transformation of coordinates of the surface points from a coordinate system followed by said sensor device of said second measuring platform into a coordinate system, following the track course, of the first measuring platform.

3. The rail vehicle according to claim 2, further comprising an evaluation device arranged on the rail vehicle, said evaluation device being designed for comparison of the coordinates of the surface points in the coordinate system of the first measuring platform to a prescribed clearance profile of the track section.

4. The rail vehicle according to claim 1, wherein said first measuring platform is mounted on one of said on-track undercarriages.

5. The rail vehicle according to claim 4, wherein said first measuring platform comprises a measuring frame arranged on wheel axles of said on-track undercarriage and having said first inertial measuring system mounted thereon.

6. The rail vehicle according to claim 5, further comprising at least two position measuring devices for determining a position of said measuring frame relative to the rails of the track mounted to said measuring frame.

7. The rail vehicle according to claim 1, wherein said second measuring platform is arranged at a front side of the rail vehicle.

8. The rail vehicle according to claim 1, wherein said sensor device comprises a laser scanner for recording the surface points as a point cloud.

9. A method for surveying a track section, the method comprising:

providing a rail vehicle according to claim 1;

recording a track course by way of the first inertial measuring system;

recording a course of motion of the at least one sensor device in three-dimensional space by way of the second inertial measuring system;

recording surface points of the track section by way of the sensor device; and calculating survey information regarding the track section from data recorded with regard to the track course, the course of motion, and the surface points.

10. The method according to claim 9, wherein:

the step of recording the track course comprises recording a course of motion of a coordinate system of the first measuring platform;

the step of recording the course of motion of the sensor device comprises recording a course of motion of a coordinate system of the second measuring platform.

11. The method according to claim 9, which comprises transforming coordinates of the surface points from a coordinate system moving along with the sensor device of the second measuring platform into a coordinate system, following the track course, of the first measuring platform.

12. The method according to claim 11, which comprises comparing the coordinates of the surface points in the coordinate system of the first measuring platform with a clearance profile of the track section.

13. The method according to claim 12, which comprises calculating a displaying a clearance profile transgression of a surface point on an output device.

* * * * *